US010176947B2

(12) United States Patent
Kim et al.

(10) Patent No.: US 10,176,947 B2
(45) Date of Patent: Jan. 8, 2019

(54) HIGH-VOLTAGE DC CIRCUIT BREAKER FOR BLOCKING DC CURRENT

(71) Applicant: HYOSUNG HEAVY INDUSTRIES CORPORATION, Seoul (KR)

(72) Inventors: Byung-Chol Kim, Incheon (KR); Se-Hee Han, Seoul (KR)

(73) Assignee: HYOSUNG HEAVY INDUSTRIES CORPORATION, Seoul (KR)

( * ) Notice: Subject to any disclaimer, the term of this patent is extended or adjusted under 35 U.S.C. 154(b) by 190 days.

(21) Appl. No.: 15/109,039

(22) PCT Filed: Dec. 30, 2014

(86) PCT No.: PCT/KR2014/013067
§ 371 (c)(1),
(2) Date: Jun. 29, 2016

(87) PCT Pub. No.: WO2015/102383
PCT Pub. Date: Jul. 9, 2015

(65) Prior Publication Data

US 2016/0329179 A1 Nov. 10, 2016

(30) Foreign Application Priority Data

Dec. 30, 2013 (KR) ..... 10-2013-0167886

(51) Int. Cl.
*H01H 33/59* (2006.01)
*H01H 9/54* (2006.01)

(52) U.S. Cl.
CPC ..... *H01H 33/596* (2013.01); *H01H 9/542* (2013.01); *H01H 9/547* (2013.01); *H01H 2009/543* (2013.01); *H01H 2009/544* (2013.01)

(58) Field of Classification Search
CPC ..... H01H 2009/543; H01H 2009/544; H01H 33/596; H01H 9/542; H01H 9/547
(Continued)

(56) References Cited

U.S. PATENT DOCUMENTS 3,737,724 A * 6/1973 Salge ..... H01H 9/54 361/11
4,172,268 A * 10/1979 Yanabu ..... H01H 33/596 307/134
(Continued)

FOREIGN PATENT DOCUMENTS

EP 1480241 A1 * 11/2004 ..... H01H 33/596
JP 59-068128 A 4/1984
(Continued)

*Primary Examiner* — Thienvu Tran
*Assistant Examiner* — Nicholas Bellido
(74) *Attorney, Agent, or Firm* — Novick, Kim & Lee, PLLC; Jae Youn Kim

(57) ABSTRACT

The present invention relates to a high-voltage direct current (DC) circuit breaker for cutting off a fault current from flowing through a line during a malfunction in a high-voltage DC line. A DC circuit breaker according to the present invention comprises: a mechanical switch disposed on a DC line; an L/C circuit connected in parallel with the mechanical switch (110), and comprising a capacitor and a reactor connected in series to each other to generate LC resonance; a first semiconductor switch, connected in parallel to the L/C circuit, for switching the unidirectional flow of the current; and a second semiconductor switch, connected in parallel to the first semiconductor switch, for switching the uni- and reverse-directional flow of current.

8 Claims, 5 Drawing Sheets

(58) Field of Classification Search
USPC ..... 361/2
See application file for complete search history.

(56) References Cited

U.S. PATENT DOCUMENTS

| | | | | | |
|---|---|---|---|---|---|
| 4,578,730 | A * | 3/1986 | Tokuyama | H01H 33/596 | 307/126 |
| 4,805,062 | A * | 2/1989 | Shirouzu | H01H 33/596 | 361/13 |
| 5,402,297 | A * | 3/1995 | Ouchi | H01H 33/596 | 361/1 |
| 5,452,170 | A * | 9/1995 | Ohde | H01H 33/596 | 174/DIG. 17 |
| 5,854,729 | A * | 12/1998 | Degeneff | H01H 33/59 | 361/4 |
| 5,883,774 | A * | 3/1999 | Kida | H02H 9/08 | 361/47 |
| 8,837,093 | B2 * | 9/2014 | Panousis | H01H 33/596 | 361/13 |
| 8,947,843 | B2 * | 2/2015 | Juhlin | H01H 71/00 | 361/115 |
| 8,995,097 | B2 * | 3/2015 | Skarby | H02H 3/087 | 361/2 |
| 9,413,157 | B2 * | 8/2016 | Tahata | H02H 3/087 | |
| 9,791,876 | B2 * | 10/2017 | Davidson | G05F 1/59 | |
| 2008/0043382 | A1 * | 2/2008 | Lee | H02H 7/001 | 361/19 |
| 2013/0020881 | A1 * | 1/2013 | Panousis | H01H 33/596 | 307/113 |
| 2016/0322177 | A1 * | 11/2016 | Hwang | H02H 3/087 | |
| 2016/0336734 | A1 * | 11/2016 | Lee | H02H 3/202 | |
| 2017/0178844 | A1 * | 6/2017 | Angquist | H01H 33/006 | |
| 2017/0352508 | A1 * | 12/2017 | Chung | H01H 33/596 | |
| 2017/0358917 | A1 * | 12/2017 | Kim | H02H 3/18 | |

FOREIGN PATENT DOCUMENTS

| | | | |
|---|---|---|---|
| JP | 09-017294 | A | 1/1997 |
| JP | 2003-123569 | A | 4/2003 |
| JP | 3965037 | B2 * | 8/2007 |
| JP | 2009181908 | A * | 8/2009 |
| KR | 10-0344056 | B1 | 7/2002 |

* cited by examiner

HIGH-VOLTAGE DC CIRCUIT BREAKER FOR BLOCKING DC CURRENT

TECHNICAL FIELD

The present invention generally relates to a high-voltage Direct Current (DC) circuit breaker and, more particularly, to a high-voltage DC circuit breaker, which is configured to, when a fault occurs in a DC line for power transmission or power distribution, block a fault current flowing through the DC line.

BACKGROUND ART

Generally, a high-voltage DC circuit breaker is a switching device capable of blocking current flowing through a high-voltage power transmission line of about 50 kV or more, such as that for a High Voltage Direct Current (HVDC) system. Such a high-voltage DC circuit breaker functions to block a fault current when a fault occurs in a DC line. Of course, such a high-voltage DC circuit breaker may also be applied to an intermediate voltage DC power distribution system having a DC voltage level of about 1 to 50 kV.

In the case of a high-voltage DC circuit breaker, when a fault current occurs in the system, the fault current is blocked in such a way as to isolate a faulty circuit by opening a main switch. However, since a point corresponding to zero (0) current is not present in the DC line, a problem arises in that an arc occurring between the terminals of the main switch is not extinguished when the main switch is opened, and the fault current continuously flows through the arc, thus making it impossible to block the fault current.

Japanese Patent Application Publication No. 1984-068128, shown in FIG. 1, discloses technology in which a high-voltage DC circuit breaker allows a main switch CB to generate zero (0) current by adding current $I_{DC}$ flowing through the main switch CB to resonant current Ip generated by an L/C circuit ($Idc=I_{DC}+Ip$) and extinguish the arc in order to extinguish the arc occurring when the main switch CB is opened and to block fault current Ic. In this conventional technology, when the main switch CB is closed, the resonant current Ip is injected to be added to the DC current $I_{DC}$, and thereafter the resonant current Ip becomes oscillating current due to LC resonance. As the current oscillates along with the main switch CB, the magnitude thereof becomes larger. In this way, negative (−) resonant current (−Ip) becomes greater than $I_{DC}$, so that the fault current Ic becomes zero current, and then the arc in the main switch CB is extinguished.

However, such conventional technology is problematic in that resonant current Ip greater than DC current $I_{DC}$ must be added, and thus the actual circuit rating must be more than twice that of the rated current, and in that, in order to generate such a high resonant current Ip, resonance must be performed several times, and thus the blocking speed is decreased. Further, the conventional DC circuit breaker is problematic in that it is impossible to block a bidirectional fault current.

DISCLOSURE

Technical Problem

Accordingly, an object of the present invention is to provide a high-voltage DC circuit breaker, which allows a main switch to block a fault current even if the high-voltage DC circuit breaker does not apply a resonant current to the main switch.

Another object of the present invention is to provide a high-voltage DC circuit breaker, which can block a bidirectional fault current using a single circuit.

A further object of the present invention is to provide a high-voltage DC circuit breaker, which can block a fault current using a small number of semiconductor devices.

Technical Solution

A high-voltage DC circuit breaker according to the present invention to accomplish the above objects includes a mechanical switch installed on a DC line; an L/C circuit including a capacitor and a reactor connected in parallel with the mechanical switch, and connected in series with each other so as to cause LC resonance; a first semiconductor switch connected in series with the L/C circuit and configured to switch a flow of current in one direction; and a second semiconductor switch connected in parallel with the first semiconductor switch and configured to switch a flow of current in a direction opposite the one direction.

In the present invention, the high-voltage DC circuit breaker may further include a charging resistor for charging a voltage (+Vc) in the capacitor.

In the present invention, the first and second semiconductor switches may be respectively turn-on/turn-off controllable and may be connected in parallel with each other and oriented in opposite directions.

In the present invention, in a steady state, the first and second semiconductor switches are turned off, and current flowing through the line is supplied to the capacitor, thus enabling an initial voltage (+Vc) to be charged in the capacitor.

In the present invention, when a fault occurs on a first side of the line, the mechanical switch may be opened, and the first semiconductor switch may be turned on in a state in which the second semiconductor switch is turned off, so that current flows through an arc formed in the mechanical switch and the first semiconductor switch using the initial voltage (+Vc) charged in the capacitor, thus enabling a polarity-reversed voltage (−Vc) to be charged in the capacitor via LC resonance.

In the present invention, when the polarity-reversed voltage (−Vc) is charged in the capacitor, the first semiconductor switch may be turned off and the second semiconductor switch may be turned on, so that current depending on the voltage (−Vc) is supplied to the mechanical switch through the second semiconductor switch, and zero current is realized in the mechanical switch using the supplied current, thus extinguishing the arc.

In the present invention, the current supplied to the mechanical switch using the voltage (−Vc) charged in the capacitor may have a direction opposite that of arc current continuously flowing through the arc in the mechanical switch and has a magnitude greater than that of the arc current.

In the present invention, when the arc is extinguished at the mechanical switch, the first and second semiconductor switches may be turned off, and current flowing through the line may be supplied to the capacitor, thus enabling the capacitor to be recharged to an initial voltage (+Vc).

In the present invention, the high-voltage DC circuit breaker may further include a nonlinear resistor connected in parallel with the mechanical switch, wherein when the arc is extinguished at the mechanical switch, a voltage on a second side of the line, which becomes higher than a voltage on the first side of the line, is consumed in the nonlinear resistor.

Advantageous Effects

According to the present invention, the high-voltage DC circuit breaker can rapidly extinguish an arc that is formed when a mechanical switch is opened, thus promptly blocking a fault current.

Further, the high-voltage DC circuit breaker according to the present invention may block a bidirectional fault current using a single circuit.

Furthermore, according to the present invention, the high-voltage DC circuit breaker may be implemented using a minimal number of electric devices, thus reducing the size and cost of circuit breakers.

BEST MODE

Preferred embodiments of the present invention will be described in detail below with reference to the accompanying drawings. Descriptions of known functions or configurations which have been deemed to make the gist of the present invention unnecessarily obscure will be omitted below.

Figure 2:
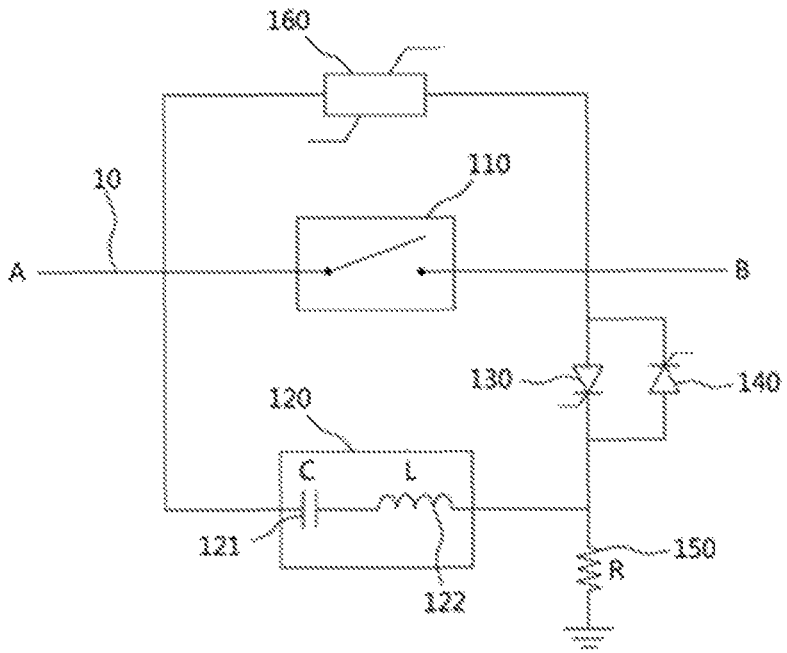
FIG. 2 is a configuration diagram showing a high-voltage DC circuit breaker according to an embodiment of the present invention.

FIG. 2 is a configuration showing a high-voltage DC circuit breaker according to an embodiment of the present invention.

Referring to FIG. 2, the high-voltage DC circuit breaker according to the embodiment of the present invention includes a mechanical switch 110 installed on a DC line 10 for connecting a first side (side A) to a second side (side B). Such a mechanical switch 110 basically functions to block the DC line 10 so as to prevent a fault current from continuously flowing into a faulty circuit when a fault occurs on side A or B. For this operation, the mechanical switch 110 is closed in a steady state, and is opened in the occurrence of a fault. The switching operation of the mechanical switch 110 is controlled in response to a control signal from a control unit (not shown). Since a high current flows through the mechanical switch 110, an arc is formed across the two end electrodes of the mechanical switch 110 when the mechanical switch 110 is opened in the occurrence of a fault, and the fault current flows through the DC line 10 via the arc. Therefore, the present invention requires an additional circuit so as to completely block the fault current by extinguishing the arc.

For this operation, in the present invention, an L/C circuit 120 and a first semiconductor switch 130 are connected in series with the mechanical switch 110, and a second semiconductor switch 140 is connected in parallel with the first semiconductor switch 130. The first and second semiconductor switches 130 and 140 are connected in parallel with each other and oriented in opposite directions so as to switch the bidirectional flow of current, wherein the first semiconductor switch 130 switches the flow of current in one direction, and the second semiconductor switch 140 switches the flow of current in the direction opposite the one direction. Each of the first and second semiconductor switches 130 and 140 includes, for example, a power semiconductor switch, and the switching operation thereof is controlled by a control unit (not shown). In the present embodiment, the power semiconductor switch may be a turn-on controllable device, and may be implemented as, for example, a thyristor. Alternatively, the power semiconductor switch may be a turn-on/turn-off controllable device and may be implemented as, for example, a Gate Turn-Off (GTO) thyristor, an Integrated Gate-Commutated Thyristor (IGCT), or an Insulated Gate Bipolar Transistor (IGBT).

The L/C circuit 120 is implemented using a capacitor 121 and an inductor 122, which are connected in series. The L/C circuit 120 performs charging and discharging of the capacitor 121, thus causing LC resonance through the first or second semiconductor switch 130 or 140.

Furthermore, in the high-voltage DC circuit breaker according to the present embodiment, a charging resistor 150 for charging the capacitor 121 may be connected between the junction of the L/C circuit 120 and the first semiconductor switch 130 and a ground GND. Through the charging resistor 150, the capacitor 131 of the L/C circuit 120 is charged to an initial voltage (+Vc).

The high-voltage DC circuit breaker according to the present embodiment may further include a nonlinear resistor 160 connected in parallel with the mechanical switch 110. Such a nonlinear resistor 160 is configured to prevent overvoltage equal to or greater than a rated voltage from being applied across the two ends of the high-voltage DC circuit breaker when the mechanical switch 110 is closed. The nonlinear resistor 160 is operated such that, when a high voltage attributable to a fault, that is, a voltage equal to or greater than a preset reference voltage, is applied across the two ends of the high-voltage DC circuit breaker 100, the nonlinear resistor 160 is automatically turned on, thus consuming the high voltage. In the present embodiment, the nonlinear resistor 160 may be implemented as, for example, a varistor.

Figure 3:
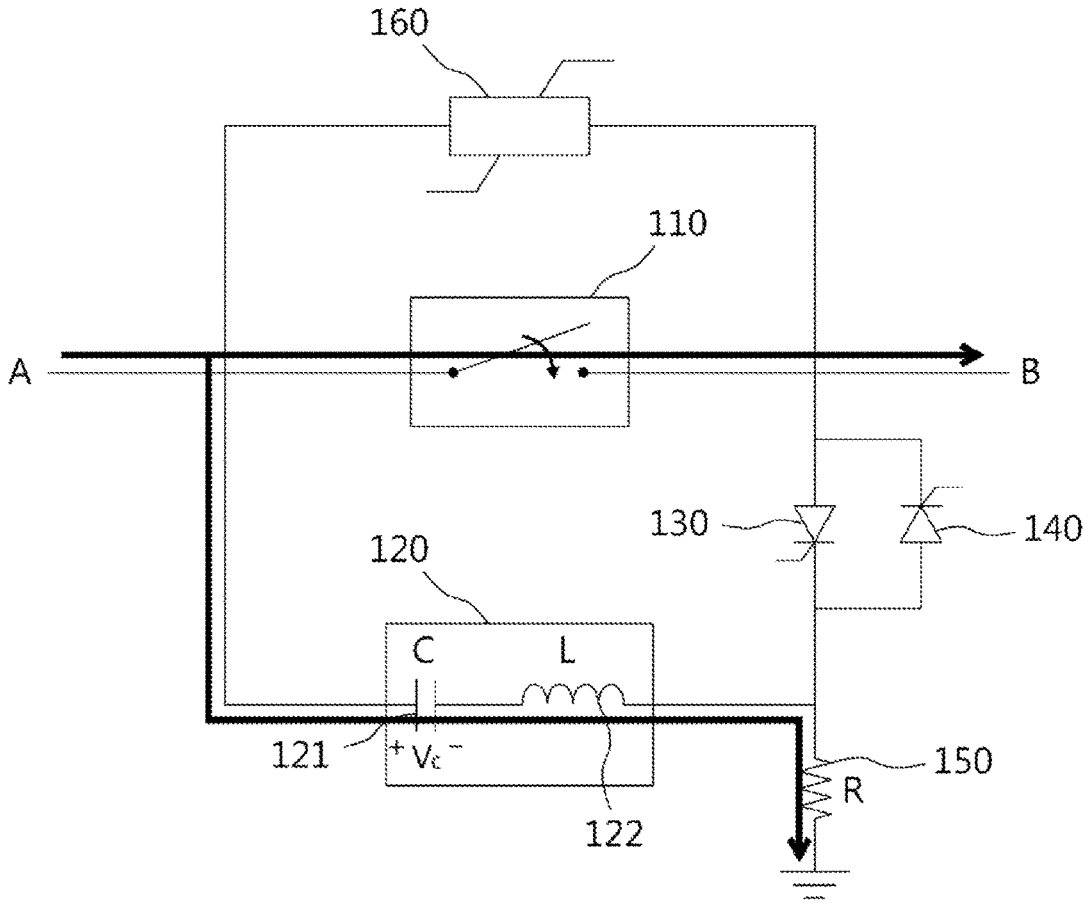
FIG. 3 is a schematic diagram showing the operating procedure of the high-voltage DC circuit breaker in a steady state according to an embodiment of the present invention.

FIG. 3 is a schematic diagram showing the operating procedure of the high-voltage DC circuit breaker in a steady state according to an embodiment of the present invention.

Referring to FIG. 3, in the high-voltage DC circuit breaker according to the present invention, the mechanical switch 110 is closed in a steady state, so that a DC current is supplied along the DC line 10 in a direction from the first side (side A) to the second side (side B) through the mechanical switch 110. Here, in the state in which the first and second semiconductor switches 130 and 140 are turned off, current flowing through the line 10 is supplied to the L/C circuit 120, thus enabling the capacitor 121 to be charged to the initial voltage (+Vc).

FIG. 4 is a schematic diagram showing a process in which the high-voltage DC circuit breaker blocks a fault current when a fault occurs on the second side of a high-voltage DC line according to an embodiment of the present invention.

Figure 4A:
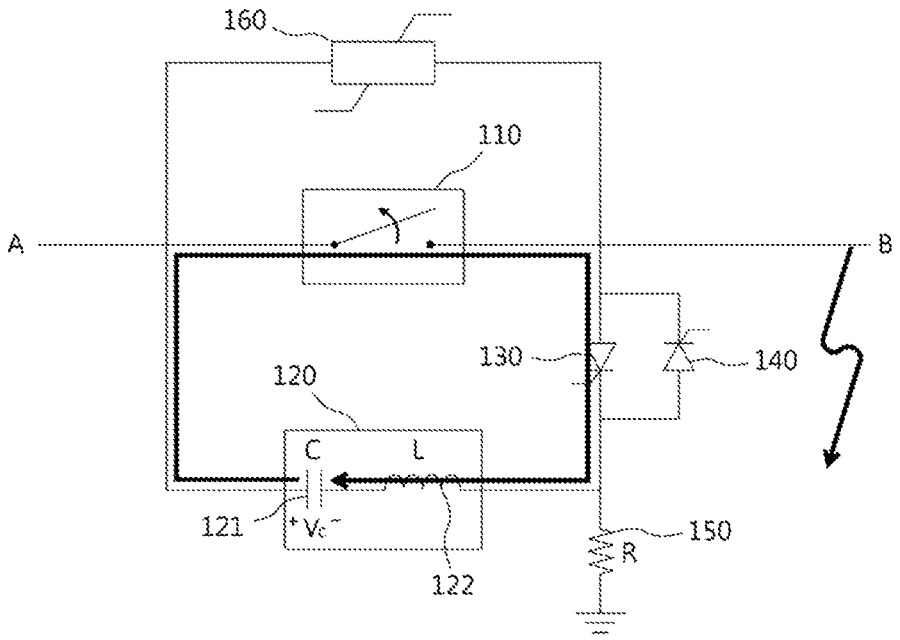
FIGS. 4A and 4B are schematic diagrams showing a process in which the high-voltage DC circuit breaker blocks a fault current when a fault occurs on the second side of a high-voltage DC line according to an embodiment of the present invention.
Figure 4B:
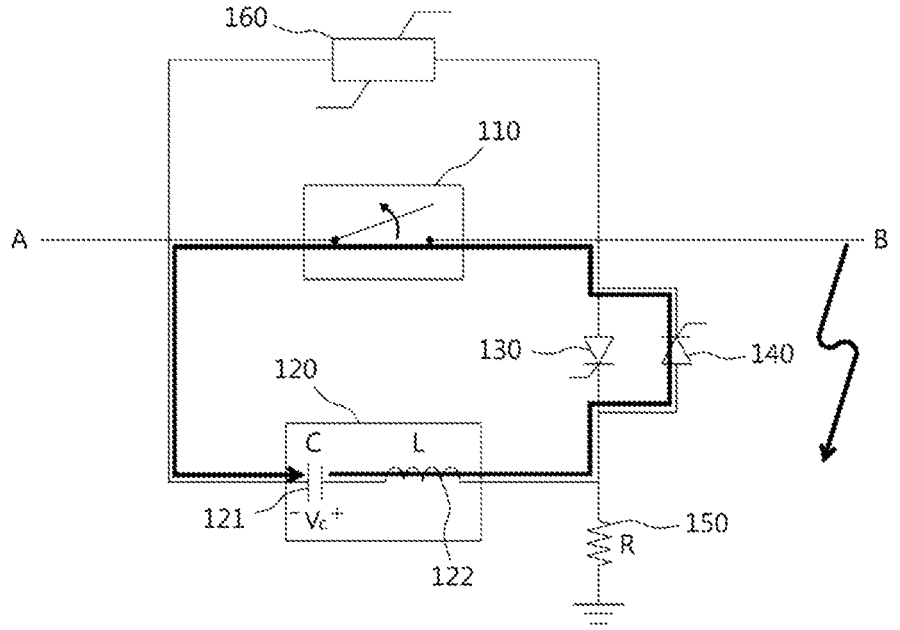

FIGS. 4A and 4B are schematic diagrams showing a process in which the high-voltage DC circuit breaker blocks a fault current when a fault occurs on the second side of a high-voltage DC line according to an embodiment of the present invention.

Referring to FIGS. 4A and 4B, in the high-voltage DC circuit breaker according to the present invention, when a fault occurs on the second side (side B), the mechanical switch 110 is opened, and the first semiconductor switch 130 is turned on in the state in which and the second semiconductor switch 140 is turned off, in order to prevent current from flowing through the line 10. When the mechanical switch 110 is opened, an arc is formed, and a fault current flows through the arc in the direction from side A to side B.

Here, as shown in FIG. 4A, as the first semiconductor switch 130 is primarily turned on, current flows through the arc formed in the mechanical switch 110 and the first semiconductor switch 130 using the initial voltage (+Vc) charged in the capacitor 121, and then LC resonance occurs in the L/C circuit 120. Depending on this LC resonance, polarity-reversed voltage (−Vc) is charged in the capacitor 121.

When the polarity-reversed voltage (−Vc) is charged in the capacitor 121 in this way, the first semiconductor switch 130 is again turned off, and the second semiconductor switch 140 is turned on, as shown in FIG. 4B, so that current flows through the second semiconductor switch 140 and the arc formed in the mechanical switch 110 using the polarity-reversed voltage (−Vc). Since the direction of this current is opposite that of the fault current in the mechanical switch 110, zero current is realized in the mechanical switch 110, and thus the arc is extinguished. Therefore, the current supplied to the mechanical switch 110 preferably has a direction opposite that of the fault current continuously flowing through the arc in the mechanical switch 110, and has a magnitude greater than that of the fault current.

Thereafter, when the arc is extinguished, both the first and second semiconductor switches 130 and 140 are turned off, and current flowing through the line 10 is supplied to the L/C circuit 120, so that the capacitor 121 is recharged to the initial voltage (+Vc). At this time, when the arc formed in the mechanical switch 110 is completely extinguished, and the fault current at the mechanical switch 110 is blocked, the voltage on side A sharply rises, compared to the voltage on side B. This rising voltage on side A is consumed in the nonlinear resistor 160, which is connected in parallel with the mechanical switch 110, thus protecting the circuit on side A.

Figure 5:
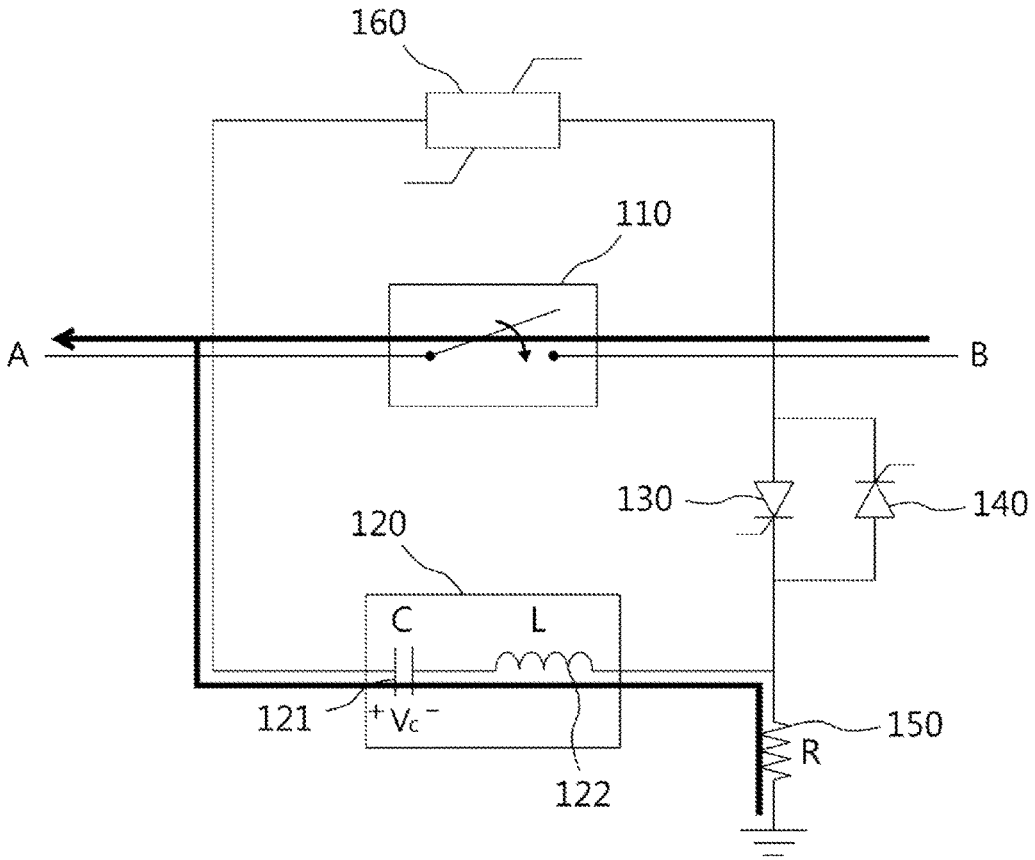
FIG. 5 is a schematic diagram showing the operating procedure of the high-voltage DC circuit breaker in a steady state according to another embodiment of the present invention.

FIG. 5 is a schematic diagram showing the operating procedure of the high-voltage DC circuit breaker in a steady state according to another embodiment of the present invention.

FIG. 5 illustrates the operating procedure of the high-voltage DC circuit breaker when current is supplied from the second side (side B) to the first side (side A), unlike FIG. 3. Referring to the embodiment of FIG. 5, the mechanical switch 110 is closed in a steady state, and a DC current is supplied along the DC line 10 in the direction from the second side (side B) to the first side (side A) through the mechanical switch 110. Here, in the state in which the first and second semiconductor switches 130 and 140 are turned off, the current flowing through the line 10 is supplied to the L/C circuit 120, so that the capacitor 121 is charged to an initial voltage (+Vc). Thereafter, when a fault occurs on the first side (side A), a fault current is blocked using the same operating procedure as that described above with reference to FIGS. 4A and 4B.

Figure 1:
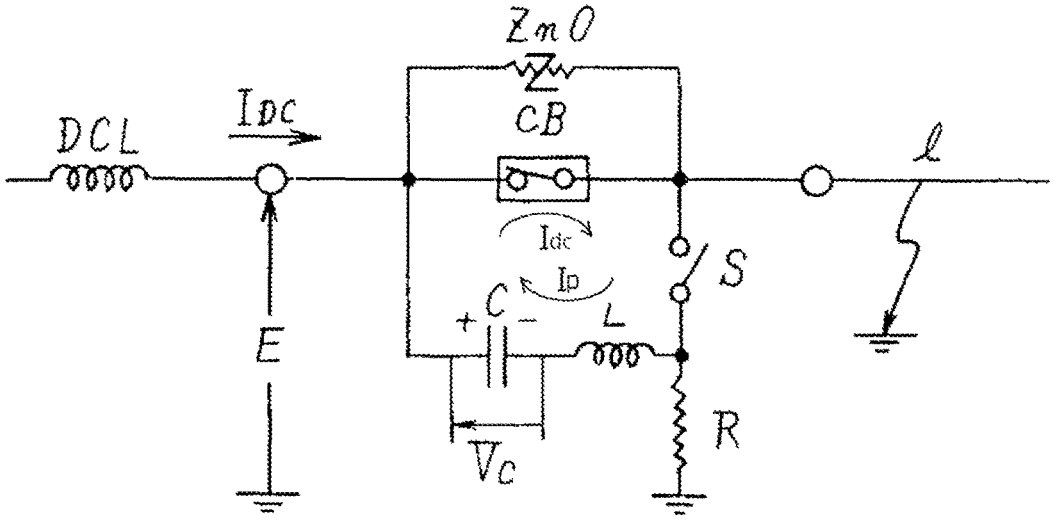
FIG. 1 PRIOR ART
FIG. 1 is a configuration diagram showing a conventional high-voltage DC circuit breaker.

As described above, the high-voltage DC circuit breaker according to the present invention performs LC resonance only once in order to reverse the voltage polarity of the capacitor 121 of the L/C circuit 120, rather than increasing a resonant current via current oscillation depending on LC resonance, as in the case of the conventional technology shown in FIG. 1. This makes the blocking of the circuit breaker faster than that of the conventional technology. Further, unlike the conventional technology of FIG. 1, the present invention extinguishes an arc by injecting current in the direction opposite that of the fault current flowing through the arc in the mechanical switch 110 using the voltage (−Vc) stored in the capacitor 121, and by generating zero current.

As described above, although the present invention has been described in detail with reference to preferred embodiments, it should be noted that the present invention is not limited to the description of these embodiments. It is apparent that those skilled in the art to which the present invention pertains can perform various changes or modifications of the present invention without departing from the scope of the accompanying claims and those changes or modifications belong to the technical scope of the present invention although they are not presented in detail in the embodiments. Accordingly, the technical scope of the present invention should be defined by the accompanying claims.

The invention claimed is:

1. A high-voltage DC circuit breaker, comprising:

a mechanical switch installed on a DC line;

an LC circuit including a capacitor and a reactor connected in parallel with the mechanical switch, and connected in series with each other so as to cause LC resonance;

a first semiconductor switch connected in series with the LC circuit and configured to switch a flow of current in one direction; and a second semiconductor switch connected in parallel with the first semiconductor switch and configured to switch a flow of current in a direction opposite the one direction, wherein, in a steady state, the first and second semiconductor switches are turned off, and a current flowing through the DC line is supplied to the capacitor to enable an initial voltage to be charged in the capacitor, wherein, when a fault occurs on one side of the DC line, the mechanical switch is opened and the first semiconductor switch is turned on in a state in which the second semiconductor switch is turned off, a current by the initial voltage charged in the capacitor flows through an arc formed in the mechanical switch and the first semiconductor switch, and then LC resonance occurs in the LC circuit and a polarity-reversed voltage is charged in the capacitor via the LC resonance in the LC circuit, wherein a current by the polarity-reversed voltage flows to the mechanical switch to extinguish the arc formed in the mechanical switch, and wherein, when the arc is extinguished, both the first and second semiconductor switches are turned off, and a current flowing through the DC line is supplied to the LC circuit, so that the capacitor is recharged to the initial voltage.

2. The high-voltage DC circuit breaker of claim 1, further comprising a charging resistor for charging a voltage in the capacitor.

3. The high-voltage DC circuit breaker of claim 1, wherein the first and second semiconductor switches are respectively turned on or turned off, and are connected in parallel with each other and oriented in opposite directions.

4. The high-voltage DC circuit breaker of claim 1, wherein, when the polarity-reversed voltage is charged in the capacitor, the first semiconductor switch is turned off and the second semiconductor switch is turned on, so that the current depending on the polarity-reversed voltage is supplied to the mechanical switch through the second semiconductor switch, and zero current is provided in the mechanical switch using the supplied current so as to extinguish the arc.

5. The high-voltage DC circuit breaker of claim 4, wherein the current supplied to the mechanical switch using the polarity-reversed voltage charged in the capacitor has a direction opposite to that of arc current continuously flowing through the arc in the mechanical switch and has a magnitude greater than that of the arc current.

6. The high-voltage DC circuit breaker of claim 4, wherein, when the arc is extinguished at the mechanical switch, the first and second semiconductor switches are turned off, and current flowing through the line is supplied to the capacitor so as to enable thus enabling the capacitor to be recharged to an initial voltage.

7. The high-voltage DC circuit breaker of claim 4, further comprising a nonlinear resistor connected in parallel with the mechanical switch, wherein when the arc is extinguished at the mechanical switch, a voltage on a second side of the line, which becomes higher than a voltage on the first side of the line, is consumed in the nonlinear resistor.

8. The high-voltage DC circuit breaker of claim 2, wherein the first and second semiconductor switches are respectively turned on or turned off, and are connected in parallel with each other and oriented in opposite directions.

* * * * *